US005131664A

United States Patent [19]

Medina

[11] Patent Number: 5,131,664

[45] Date of Patent: Jul. 21, 1992

[54] ROTATABLE POOL TABLE

[76] Inventor: Conrad R. Medina, 945 E. Kenilworth Ave., Palatine, Ill. 60067

[21] Appl. No.: 619,487

[22] Filed: Nov. 29, 1990

[51] Int. Cl.[5] ..... A63D 15/00

[52] U.S. Cl. ..... 273/3 B; 273/12; 273/123 R; 273/126 R

[58] Field of Search ..... 273/3 B, 3 A, 3 C, 12, 273/14, 126 R, 127 B, 128 R; 108/102, 103, 124, 139, 150, 157, 130

[56] References Cited

U.S. PATENT DOCUMENTS

| | | | |
|---|---|---|---|
| 296,677 | 4/1884 | Chasley | 273/3 R |
| 445,626 | 2/1891 | Cogswell | 273/3 B |
| 895,786 | 8/1908 | Perkins | 273/3 B |
| 1,512,442 | 10/1924 | Arnold | 273/3 B |
| 1,935,682 | 11/1933 | Wege | 108/150 |
| 1,962,576 | 6/1934 | Stackelberg | 273/126 R |
| 2,159,966 | 5/1939 | Dunham | 273/126 R |
| 2,808,223 | 10/1957 | Abeles et al. | 108/139 |
| 3,055,721 | 9/1962 | Holt | 108/150 |
| 3,711,099 | 1/1973 | Milu | 273/3 C |
| 3,871,655 | 3/1975 | Zimmer | 273/3 C |
| 3,947,035 | 3/1976 | Bouchard | 273/126 R |
| 4,017,079 | 4/1977 | Apellaniz | 273/126 R |
| 4,146,228 | 3/1979 | Laciste | 273/126 R |

FOREIGN PATENT DOCUMENTS

| | | | |
|---|---|---|---|
| 0664293 | 2/1988 | France | 273/126 R |
| 3303 | of 1889 | United Kingdom | 273/128 R |
| 513 | of 1906 | United Kingdom | 273/85 R |
| 2097682 | 11/1982 | United Kingdom | 273/126 R |
| 2154888 | 9/1985 | United Kingdom | 273/126 R |

*Primary Examiner*—Theatrice Brown

[57] ABSTRACT

A rotary pool table with sliding disc-type cue and player discs, constructed with a base having radial, widely spaced rollers for supporting the table bed for rotation and a tensioning rod assembly for controlling resistance to table rotation and table bed stability. The player discs have convex or concave surfaces that control disc speed, and the table pockets have removable trays mounted in slides. The top of the table bed has a visible line near the side rails that give the player relief from a tight cue disc lie along the rails.

7 Claims, 8 Drawing Sheets

4 PLAYERS

3 PLAYERS

2 PLAYERS

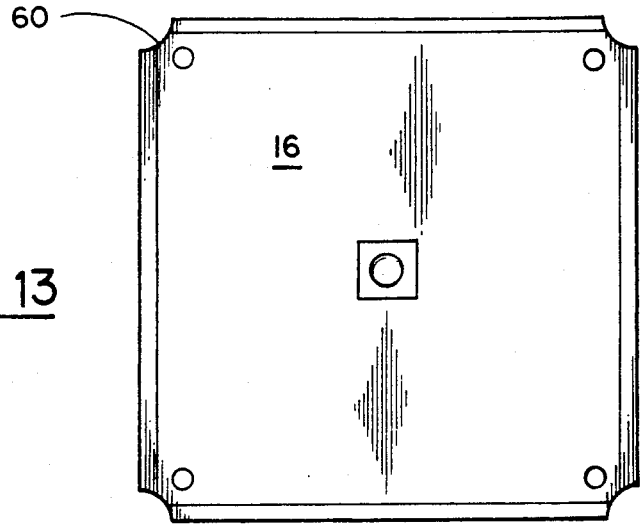
FIG. 13
FIG. 14
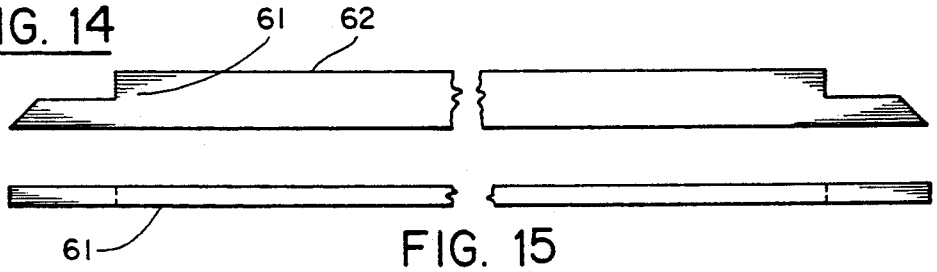
FIG. 15
FIG. 16
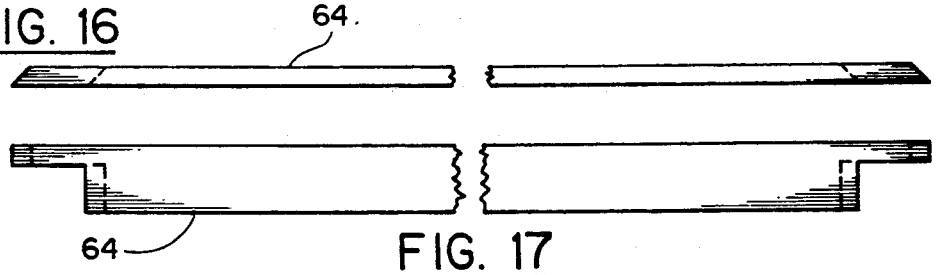
FIG. 17
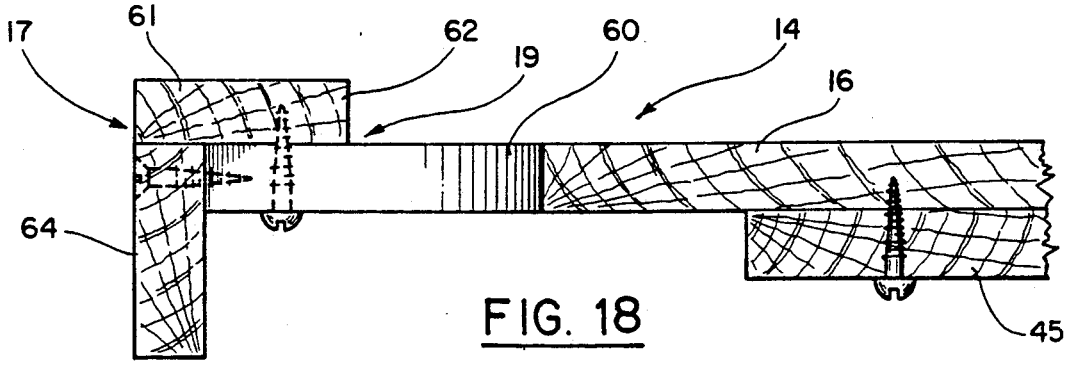
FIG. 18

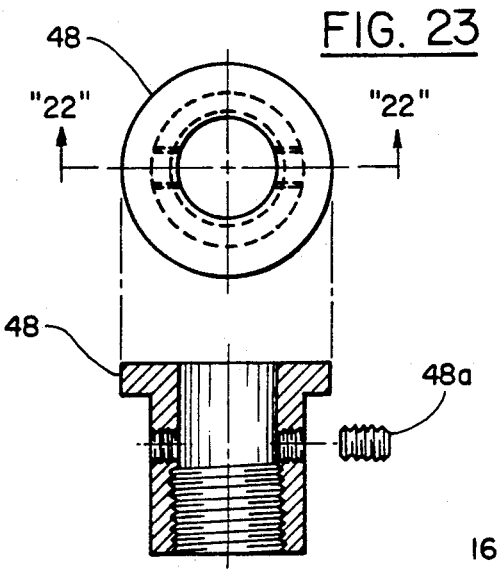
FIG. 23
FIG. 22
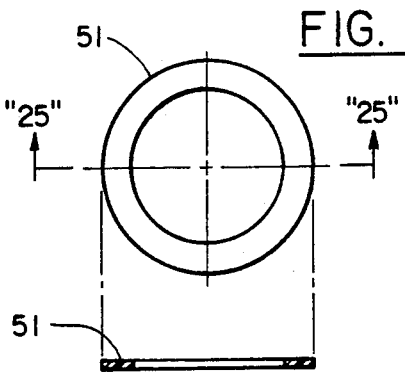
FIG. 24
FIG. 25
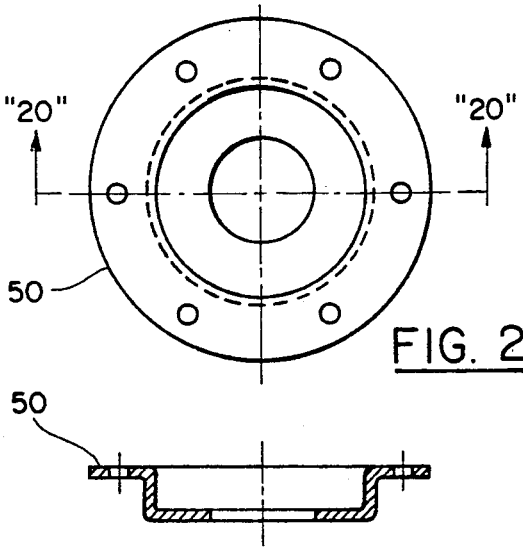
FIG. 21
FIG. 20
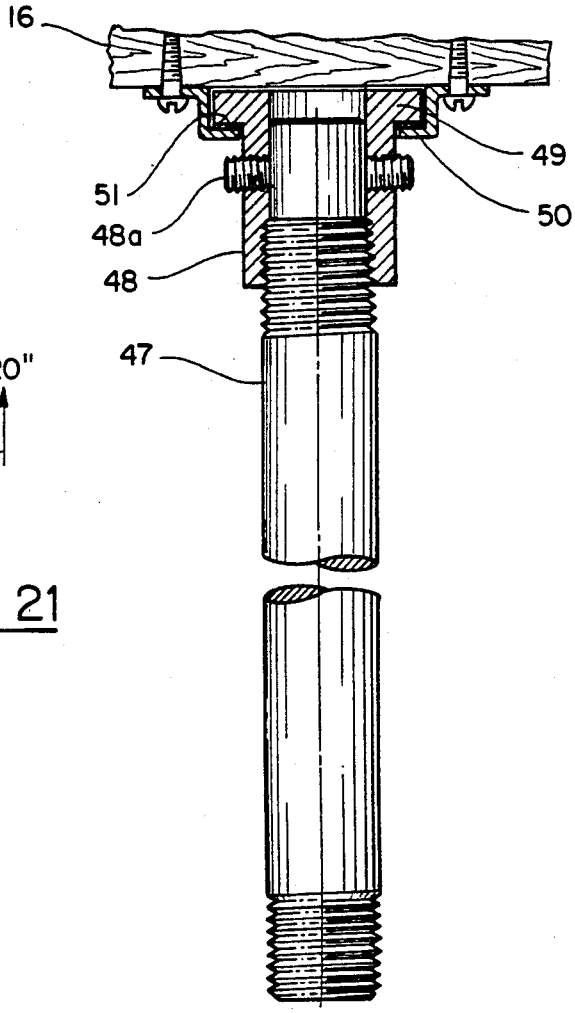
FIG. 19

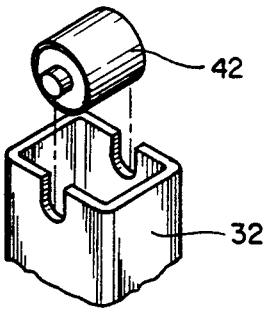
FIG. 26
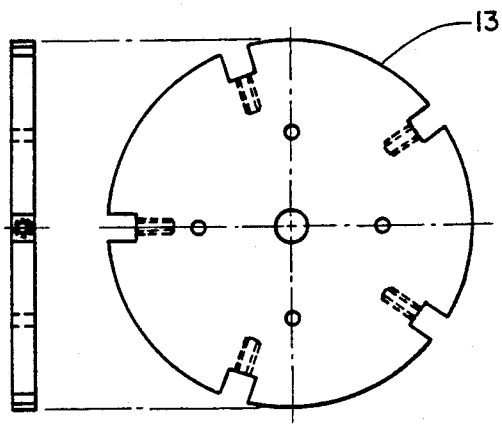
FIG. 30 FIG. 29
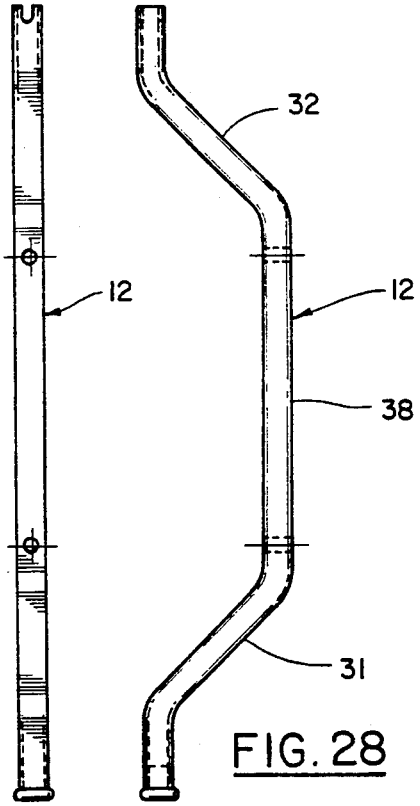
FIG. 28
FIG. 27
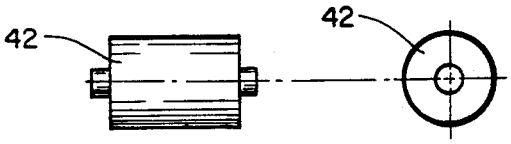
FIG. 31 FIG. 32
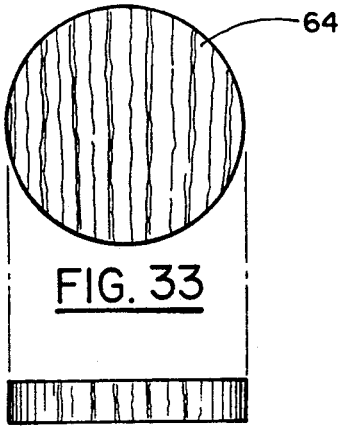
FIG. 33
FIG. 34

ROTATABLE POOL TABLE

BACKGROUND OF THE INVENTION

Rotary pool tables have been existent for many decades and have achieved some degree of popularity because they can be positioned near a wall which would otherwise prevent the player from using a conventional-length cue stick, or for that matter inhibit the player's body between the table and the wall. When a shot is desired on the wall side of the table, the table is merely rotated 180 degrees. It is also possible to utilize the rotary feature to execute all pool shots from a specified player location.

Such rotary tables have two basic disadvantages, one being the disturbance of the playing elements as the table is being rotated, and the other is table stability which is a problem of course in all forms of pool tables. The first has been in part solved by providing discs on the table as opposed to conventional spherical pool balls which of course would roll as the table is being rotated.

The second problem of table stability results from the need of some type of turntable mechanism for the table and thus far the rotary assemblies for the tables provided in the past have not achieved the degree of stability required for commercialization of rotary pool tables, and it is to this deficiency that the present invention in part addresses itself.

Another problem in prior disc type rotary tables is that it is very difficult to strike the cue disc with a cue stick when it is very near or against one of the table side rails.

Examples of rotary prior art billiard and pool tables are found in the Pottin, U.S. Pat. No. 175,495; the Cogswell, et al., U.S. Pat. No. 445,626; the Haskell, U.S. Pat. No. 648,560; the Lawrence, et al, U.S. Pat. No. 662,948; the Knoedler, U.S. Pat. No. 3,353,777; the Porath, U.S. Pat. No. 3,522,778; the Lacson, U.S. Pat. No. 3,547,443; the Zimmers, et al, U.S. Pat. No. 3,871,655; the Bouchard, U.S. Pat. No. 3,947,035 and the Laciste, U.S. Pat. No. 4,146,228.

Each of these patents has one or more of the deficiencies noted above.

The Lacson patent discloses a rotary table with disc-type elements in which the discs have recesses formed in them so that the cue stick can achieve engagement with the discs. However, these recesses because they are not formed on the sides of the discs, when impacted by the cue stick, tend to cause the cue discs, or the player's disc for that matter, to bounce on the table top and this of course is not desirable.

It is a primary object of the present invention to provide a rotary table for a disc-type payer and cue member pool game ameliorating the problems noted above in the prior art.

SUMMARY OF THE PRESENT INVENTION

In accordance with the present invention, a rotary pool table is provided with a plurality of sliding disc-type playing members that is substantially more stable than prior art rotary tables and has specially shaped discs to control the speed of the discs so that the less adept players can play with the slow discs and the more adept players the fast ones.

The prior problem of the cue disc being inaccessible when adjacent the table bed side rails has been obviated by a visible relief line on the table top that permits a player relief with the cue when on or outside such line.

The rotation assembly for the table includes a plurality of tubular legs that are spread out at their upper ends and carry polyurethane rollers engageable with the bottom of the table bed. These rollers are radially positioned with respect to table center, and the table is square, and they are widely spaced near the periphery of the table to provide vastly improved table stability.

The center of the rotary assembly for the table is provided with a tensioning rod that has a headed upper connector in a retainer plate and thrust bearing attached to the central bottom of the table. An adjusting system is provided for controlling the downward force on this tension rod to control the resistance to table rotation.

An important aspect of the present invention is that the tensioning of the table top against the rollers not only controls resistance to rolling, it also controls table stability so the tensioning rod also provides a table assembly having far greater table stability than in prior known rotary pool tables.

Other objects and advantages of the present invention will appear more clearly from the following detail description of the invention.

BRIEF DESCRIPTION OF THE DRAWINGS

FIG. 13 is a top view of the table bed subassembly;

FIG. 14 is a top view of one of the four identical side rails;

FIG. 15 is a side view of the side rail illustrated in FIG. 14;

FIG. 16 is a top view of the bottom section of the side rail illustrated in FIG. 14 and 15;

FIG. 17 is a side view of the bottom section of the side rail illustrated in FIG. 16;

FIG. 18 is a fragmentary vertical section through the table bed at one of the corners illustrating the side rail construction;

FIG. 19 is a side view of the tension rod assembly according to the present invention;

FIG. 20 is a cross section of the retainer plate in the tension rod assembly illustrated in FIG. 19;

FIG. 21 is a top view of the retainer plate illustrated in FIG. 20;

FIG. 22 is a cross section through the tension rod connector illustrated in FIG. 19;

FIG. 23 is a top view of the connector illustrated in FIG. 22;

FIG. 24 is a top view of a low friction washer illustrated in FIG. 24;

FIG. 25 is a cross section of the washer illustrated in FIG. 24;

FIG. 26 is an exploded perspective of one of the roller assemblies illustrated in FIG. 12;

FIG. 27 is a front view of one of the legs illustrated in FIGS. 1 and 12;

FIG. 28 is a side view of the leg illustrated in FIG. 27;

FIG. 29 is a top view of one of the positioning plates shown in FIGS. 1 and 12;

FIG. 30 is a side view of the positioning plate illustrated in FIG. 29;

FIG. 31 is a side view of one of the rollers illustrated in FIG. 26;

FIG. 32 is an end view of the roller illustrated in FIG. 31;

FIG. 33 is a top view of a cue disc according to the present invention;

FIG. 34 is a side view of the cue disc illustrated in FIG. 33;

DETAILED DESCRIPTION OF THE PREFERRED EMBODIMENTS

Figure 1:
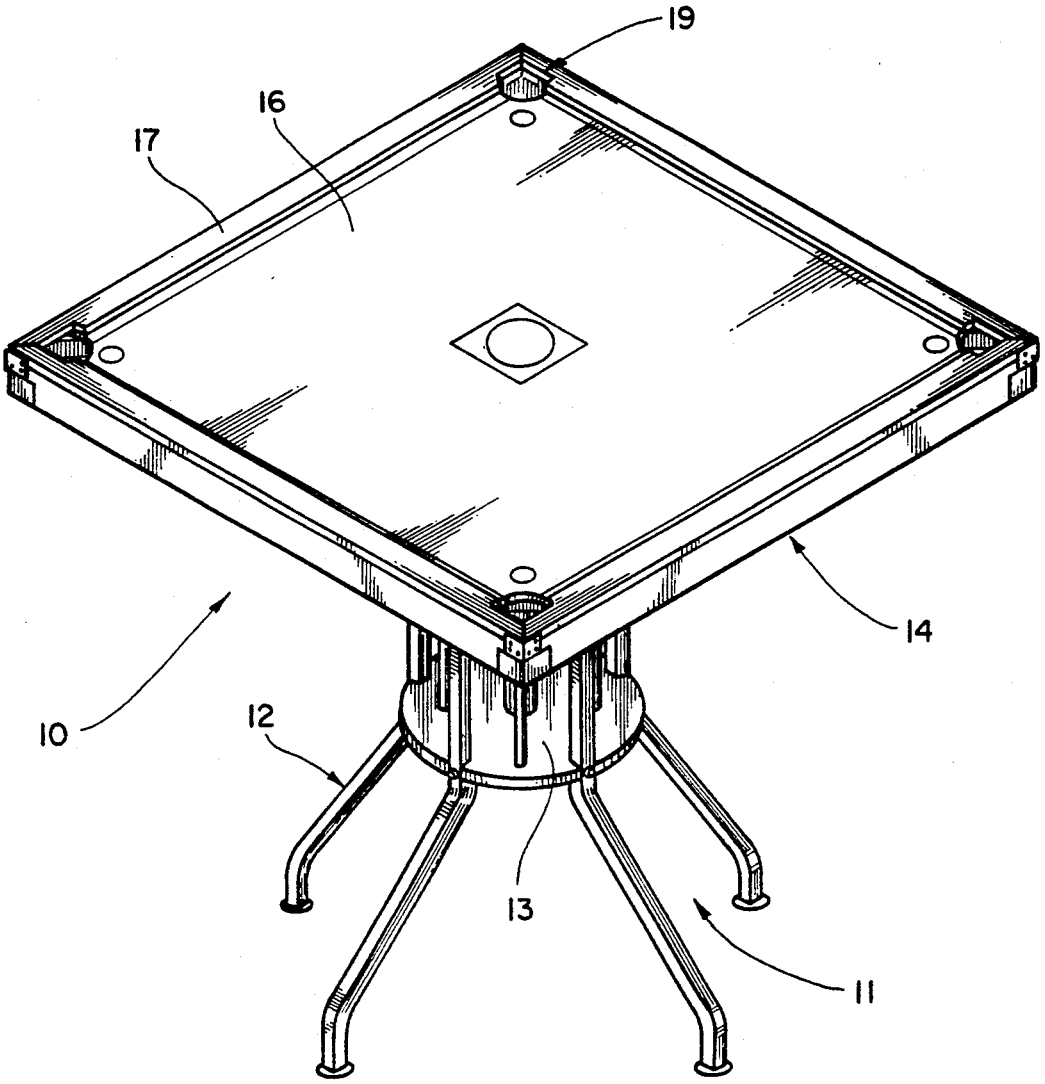
FIG. 1 is a perspective view of a rotary pool table assembly according to the present invention.

The present new and improved pool table is intended to be utilized with a new disc-type pool game. The table is manually rotatable with removable corner pockets and with sixteen or less equal size player discs with micro convex surfaces. Four of the player discs are numbered and the other have different color centers.

The number of colors and quantity per color of the colored center player discs varies with the number of players. If four players, there will be four different colors of colored center discs with three discs each color; for three players, three different colors with four discs each color; and for two players two different colors with six discs each color (see FIGS. 2 to 4).

A cue disc is used in knocking the player discs into the corner pockets. A cue stick is employed to propel the cue disc. The game is much like a standard pool game except (a) it is played with discs instead of balls; (b) playing table is manually rotatable so a player can do the shot from the same position or location, and (c) the rules are different.

OBJECT OF THE GAME

The main object of the game is to accumulate points by knocking the player discs (colored center discs) into the corner pockets. The goal is to equal or exceed a pre-determined point total. The player who first reaches or exceeds the pre-determined or agreed upon total points wins. For example, the players would agree at the outset on total points of say 50. The player who first accumulates 50 points or more wins the game.

HOW TO SCORE

Each colored-center disc is worth 5 points (any value can be assigned). To score, a player must knock in the designated color player discs. Example: There are three players: A, B and C. Therefore, there will be four player discs of each color. Say the colors are blue, green and red. Player A selects blue; Player B, red; and Player C, green. If Player A knocks in all four blue colored-center discs, Player has $4\times5$ or 20 points. In addition, if Player A is the first one to knock in all Player A's player discs, Player A also receives 10 additional bonus points for a total point score of $20+10$ or 30. But, if in the process of knocking in all blue discs, Player A either accidentally or intentionally knocked in two numbered discs, say 3 and 5, Player A's total points will be reduced by the sum of the numbers. In this case, it will be reduced by $(3+5)$ or 8 points. Therefore, Player A's net total points is $30-8=22$ points. Now, if Player A, in the process of knocking in all blue discs also knocked in, accidentally or intentionally, two green (Player C) player discs and one red (Player B) player disc, the points, 10 (two green discs) and 5 (one red disc) belong to Player C and Player B respectively. The round ended when Player A knocked in all the blue player discs. So, for this example, if Players B and C did not knock in any of their designated player discs besides what Player A knocked in the pockets (two green player discs and one red player disc) in the process of knocking in all blue player discs, the score at the end of the first round is: Player $A=22$ points; Player $B=5$ points; and Player $C=10$ points. Hence, if the agreed upon total points for a game is 50 points, it may take more than two rounds before a player wins. To repeat—any point value can be assigned to the player discs (colored-center discs).

RULES TO OBSERVE

Figure 2:
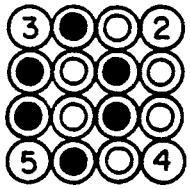
FIGS. 2 to 4 are starting disc arrangements for four, three and two players respectively each adapted to be placed in the initial starting square in the center of the table illustrated in FIG. 1.
Figure 3:
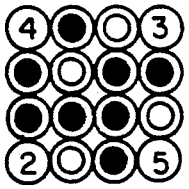
Figure 4:
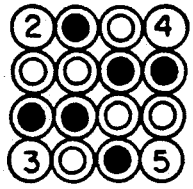

1. At the start of the game, the player discs should be arranged as shown in FIGS. 2 to 4. The numbered payer discs are positioned on the corners of the arrangement, and the colored player discs dispersed at random withn the square boundary.

2. The starting position of the cue disc is in any of the four corners directly in front of the pockets.

3. The players must select their colors at the outset. The player who shoots first is determined by rolling a die. The die provided has colors on its faces instead of numbers. Whichever player's color faces up first begins the play. The order of turn is determined by the same method. For example, say there are four players: A, B, C and D. The colors selected by the players are blue, green, yellow and red respectively. The first roll of the die, yellow cam first (C), second roll of the die, green (B) came up, and third roll, blue (A) and last then is red (D). The sequence of turns then is: Player C first; B second, A is third and D last. Or, Player B follows C, A follows B, D follows A and the sequence repeats.

4. A player continues to shoot until (a) that payer misses knocking in his or her own designated color player disc, (b) knocks in another player's player disc, (c) knocks in the cue disc or (d) knocks any of the player discs and/or the cue disc off the playing table. So if any of a, b, c or d happens, the turn is relinquished to the next player.

5. If the cue disc is knocked in a corner pocket, it should be placed as a starting position, on a circle in front of that corner pocket. If knocked off the playing table, the starting position for the cue disc will be in a circle in front of the corner pocket nearest the point where the cue disc was knocked off the playing table.

6. Any player disc knocked off the playing table must be replaced in the center of the table within the circle in the square boundary (see FIG. 1).

7. If the cue disc rests against or is near the inside edge of the table but passes the Option Line (see FIG. 5), the player may choose to move the cue disc just past the Option Line.

8. The player does not lose his or her turn as long as on each shot, he or she knocks in his or her designated player disc even though on the same shot, other player discs are knocked in the corner pockets.

Viewing the drawings and particularly FIG. 1, the present rotary pool table 10 is seen to include a base assembly 11 including five square tubular legs 12 and two positioning plates 13 only one of which can be seen in FIG. 1 and an upper bed assembly 14 supported for rotation on base 11. The bed assembly 14 includes a square bed 16 having four identical side rail assemblies 17 that form with the bed 16 four corner pocket assemblies 19.

Figure 5:
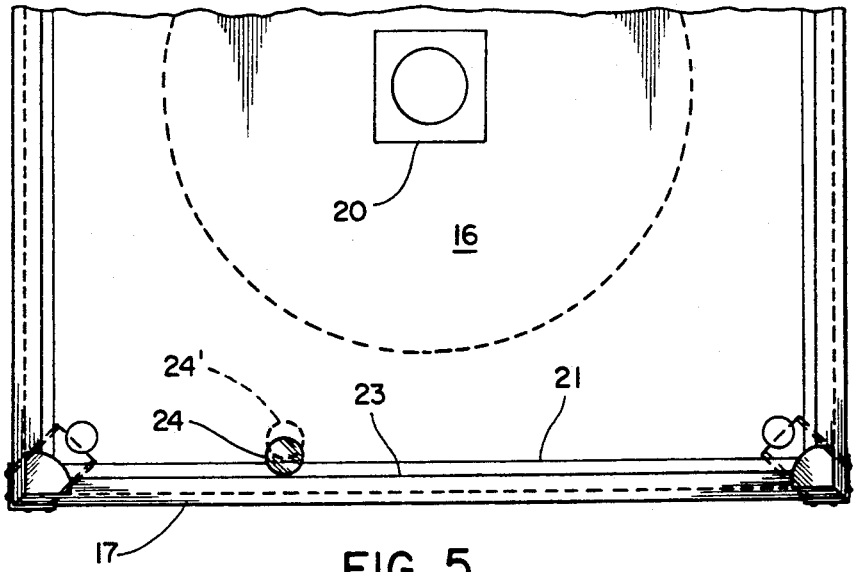
FIG. 5 is a fragmentary top view of the table bed illustrated in FIG. 1.
Figure 6:
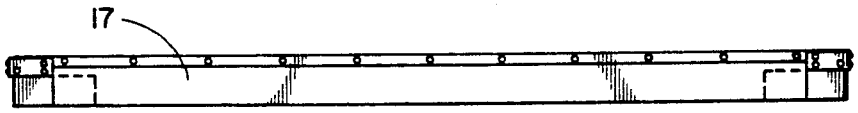
FIG. 6 is a side view of the table bed illustrated in FIG. 5.
Figure 7:
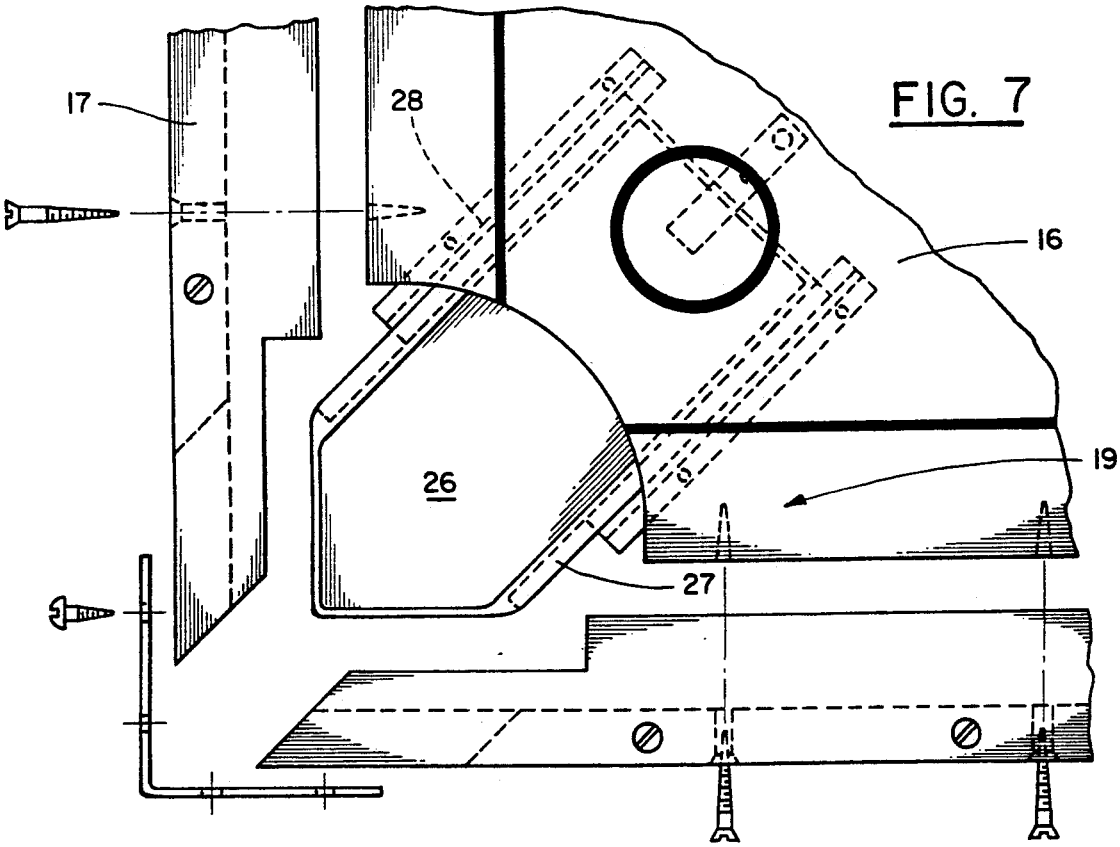
FIG. 7 is an exploded top view of one corner of the table showing one of the table pocket assemblies.

As seen more clearly in FIG. 5, the upper surface of the bed 16 has a visually highlighted starting square 20 that is sized to just circumscribe the disc starting formations illustrated in FIGS. 2, 3 and 4.

The top of the bed 16 also has a peripheral option line 21 extending completely there-around closely adjacent inner edge 23 of the side rails 17. The line 21 is positioned from side rail edge 23 a distance slightly less than the radius of cue disc 24 shown in FIG. 5. When the cue disc 24 overlies line 21, the player may shift the cue disc to position 24' where its peripheral edge just engages the line 21 so in this way the side of the cue disc is at all times accessible to the tip of the cue stick.

Figure 8:
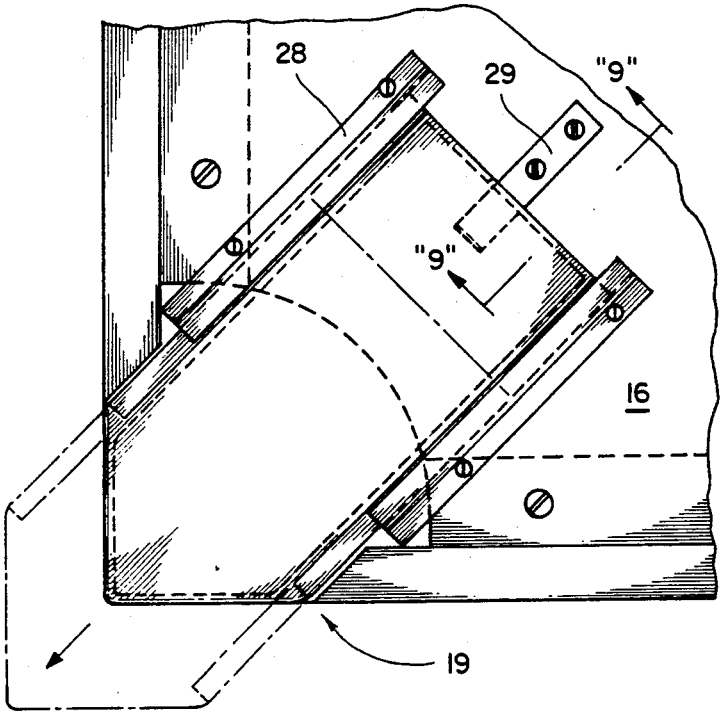
FIG. 8 is a bottom view of the pocket assembly illustrated in FIG. 7.
Figure 9:
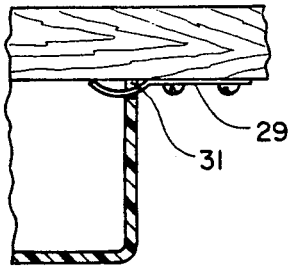
FIG. 9 is a fragmentary section taken generally along line 9—9 of FIG. 8.
Figure 10:
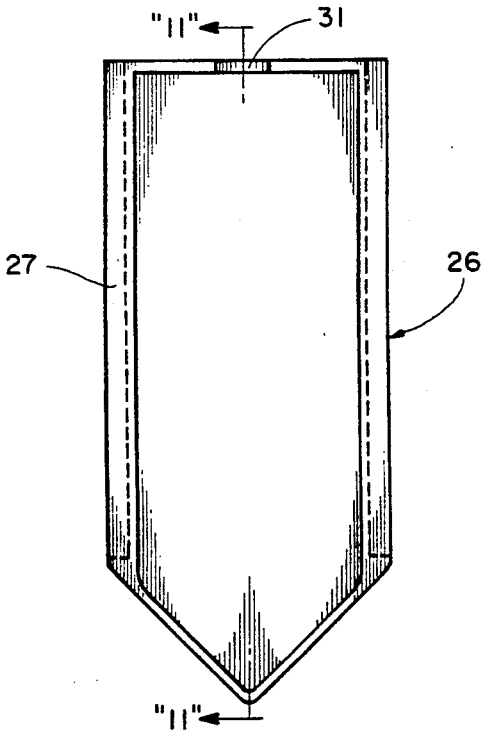
FIG. 10 is a top sub-assembly view of one of the pocket trays.
Figure 11:
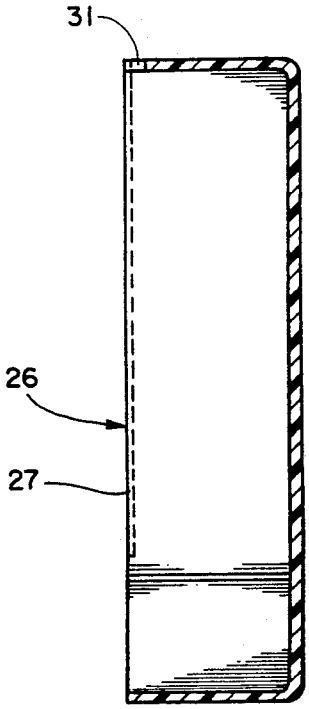
FIG. 11 is a longitudinal section taken generally along line 11—11 of FIG. 10.

As seen more clearly in FIGS. 7, 8, 9, 10 and 11, each of the pocket assemblies 19 includes a one-piece molded plastic tray 26 having side flanges 27 that slide in S-shaped aluminum tracks 28 mounted on the lower side of table bed 16. As seen in FIGS. 8 and 9, a clip 29 is fixed to the lower surface of bed 16 that engages a recess 31 in the tray to hold the tray releasably in position.

The areas under the trays 26 are open so that the player can remove the tray by grasping its underside and pulling outwardly. After the pocketed discs have been removed, the tray is inserted in the reverse manner.

Figure 12:
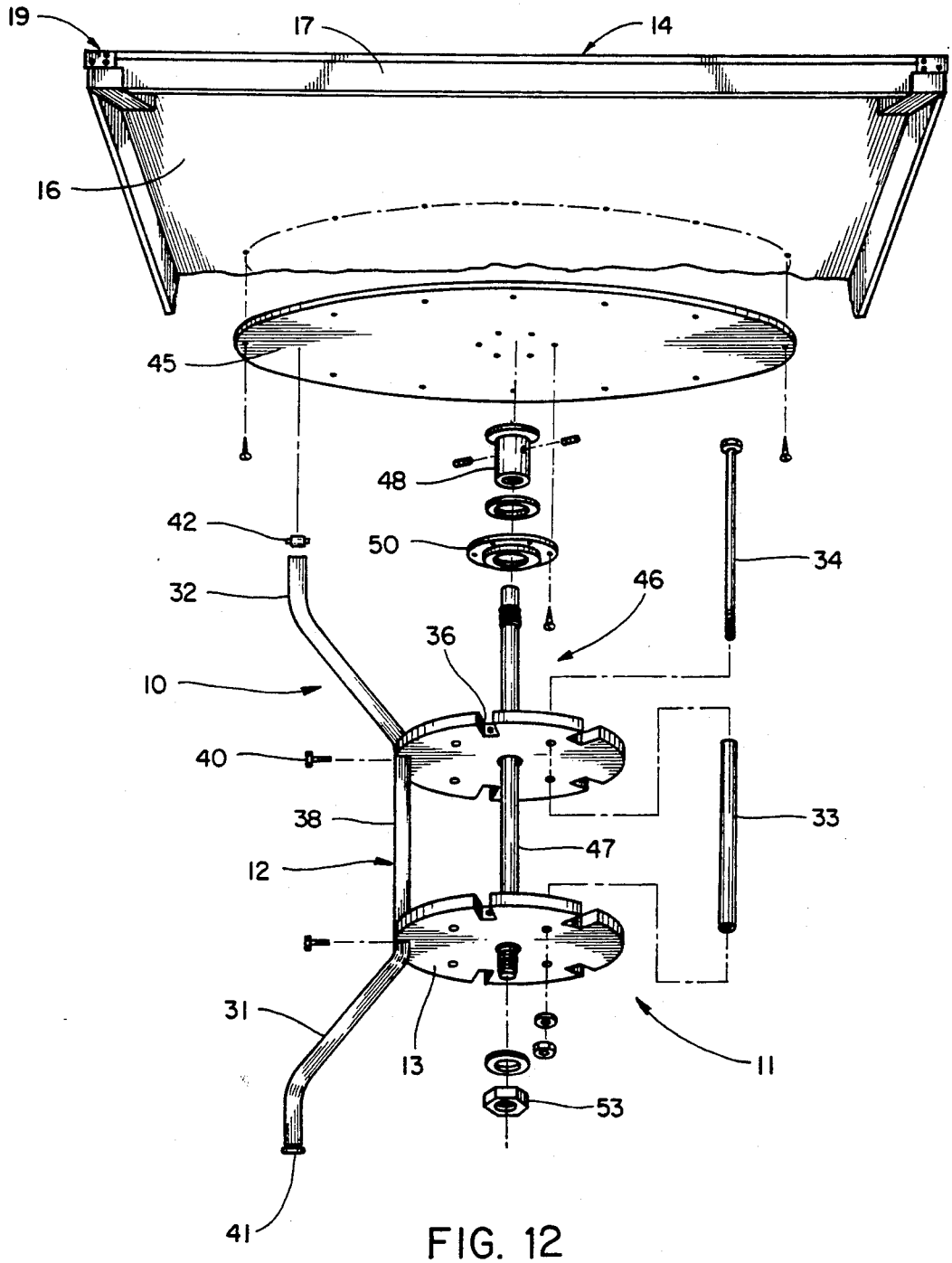
FIG. 12 is an exploded perspective of the pool table assembly illustrated in FIG. 1 with four of the five legs eliminated for clarity and simplicity.

The exploded view of the present rotary table assembly shown in FIG. 12 more clearly illustrates its manner of construction and operation.

The base 11 includes five of the legs 12 each of which is steel square tubular in construction with their lower ends 31*a* and upper ends 32 bent outwardly so that the effective diameter of the base 11 is almost equal to the length of the sides of the table bed assembly. The plates 13 in base 11 are aluminum plates and are spaced apart by four spacer sleeves 33 connected between the plates by an equal number of tie rods 34. Plates 13 have five rectangular slots 36 that receive the straight central portions 38 of the legs 12 to lock the support plates and legs together as a rigid assembly with screws 40.

The lower ends of the legs 12 have leveling pads 41 to assure accurate leveling of the bed 14.

The upper ends 32 of the legs 12 and as seen more clearly in FIG. 26 have polyurethane rollers 42 mounted therein that are disposed radially with respect to the geometric center of the bed 14.

Rollers 42 roll on a smooth finish plate 45 securely fastened to the bottom of bed 16.

According to the present invention a tensioning assembly 46 is provided for stabilizing rotary movement of the bed 14 and also controlling its resistance to rotation. Toward this end a tensioning rod 47 is provided having its upper end threadedly received in a headed collar 48 and fixed thereto by set screws 48*a*. Collar head 49 is rotatably mounted in a retainer 50, as shown more clearly in FIGS. 19, 20, 21, 22, 23, 24 and 25 that slidably engages a teflon washer 51. Retainer 50 is fixed to table bed 16 and rotates therewith while collar 48 remains stationary with rod 47 and base 11.

The lower end of the rod 47 projects through central apertures in the plates 13 and receives a nut 53 that is rotated to adjust table tension as desired.

By threading nut 53 upwardly on rod 47, rod 47 pulls of bed 14 downwardly at its center forcing plate 45 more tightly into engagement with the polyurethane rollers 42 thereby increasing roller tension and their resistance to table rotation. In addition to increasing table resistance, the tensioning system 46 also provides increased stability to the table bed heretofore not known in the prior art.

As seen clearly in FIG. 18, which illustrates a radial cross section at one of the table corners, and noting bed 16 is cut out at 60 to form a portion of one of the pockets 19, side rail assemblies 17 include a side rail top piece 61 having a bumper surface 62 also shown in FIGS. 14 and 15. Rail member 16 is screwed to the top of the bed 16, and a lower side rail member 64 is provided under top member 61 and is shown in FIGS. 16 and 17 as well.

Figure 35:
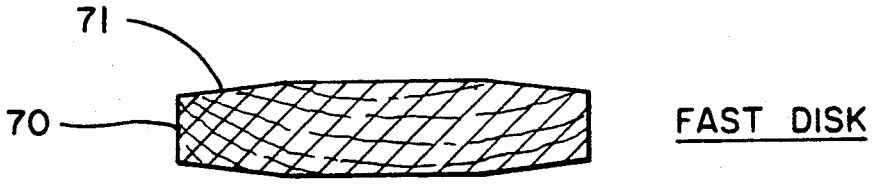
FIG. 35 is a cross section through one of the player discs according to the present invention.
Figure 36:
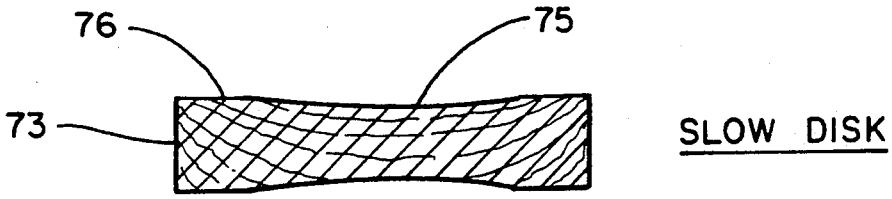
FIG. 36 is a cross-section of another embodiment of the player disc according to the present invention.

As seen in FIG. 33, cue disc 24 has flat parallel sides and is preferably constructed of a hardwood material as are the player discs illustrated in FIGS. 35 and 36. Disc 70 illustrated in FIG. 35 has convex upper and lower surfaces to reduce sliding friction and also its reduced thickness outer portion as indicated at 71 provides a curved surface that rides over a small amount of foreign matter on the table to minimize the slowing effect of dirt.

Player disc 73 illustrated in FIG. 36 has concave top and bottom surfaces 75 with peripheral flat wall ring portions 76. The aerodynamics of disc 73 are such that it provides a slower disc than would be provided by flat side walls, apparently because of the air pocket between the lower side wall 75 and the upper surface of the table bed 16. It should be understood in this connection that the upper surface of the table bed 16 is a hardwood surface and it is very smooth and has a plurality of finish coats of hard polyurethane thereon so that the surface is as fast as practically possible.

I claim:

1. A rotary table for a flat disc pool game, comprising: a substantially horizontal table bed having a base, said base including a plurality of vertically extending spaced apart support legs, said bed having a center and is supported on top of the support legs, said bed having peripheral side rails mounted on its upper surface and having a plurality of pockets formed therein, a plurality of discs on the bed adapted to be propelled into said pockets, said support legs terminating in upper ends spaced a substantial distance from the table bed center to promote table stability, a roller mounted on the upper end of each support leg and engaging a smooth lower surface of said table bed to promote smooth table rotation, each of said rollers having an axial length greater than its diameter and a substantially uniform diameter, and a table rotation tension adjusting assembly including a substantially vertical tension rod extending between said bed and said base for providing a downward force on the bed center, said tension rod being fixed to said bed center but rotatable relative to the underside of said bed at its upper end, and an adjustable fastener engaging the lower end of the tension rod, said lower end extending through said base and receiving said adjustable fastener to allow varying the force said bed exerts on the rollers.

2. A rotary table for a flat disc pool game as defined in claim 1, wherein the tension adjusting assembly includes a retainer fixed to the bottom of the table bed at said center with a low friction washer inserted therein, said tension rod having an upper head rotatably positioned in said retainer and engaging said low friction washer, said rod having a threaded lower end receiving a threaded nut whereby tightening said nut pulls downwardly on said rod forcing said table downwardly against said rollers so roller tension and table rotation resistance can be easily varied.

3. A rotary table for a flat disc pool game as defined in claim 1, wherein the rollers are plastic and have a durometer of approximately Shore A 90.

4. A rotary table for a flat disc pool game as defined in claim 1, wherein said plurality of legs having floor engaging lower ends.

5. A rotary table for a flat disc pool game as defined in claim 4, including a level device on the lower end of each leg.

6. A rotary table for a flat disc pool game, comprising: a base and a plurality of upwardly extending and widely spaced support posts, a table bed having a center supported on top of the support posts having peripheral side rails mounted thereon, a plurality of pockets formed in the table bed, a plurality of discs on the bed adapted to be propelled into the pocket, said support posts terminating in upper ends spaced a substantial distance from the table bed center to promote table stability, rollers mounted on radial axes with respect to the table bed center one one each of the upper ends of the support posts adapted to engage a smooth lower surface on the table bed to promote smooth table rotation, and a table rotation tension adjusting assembly including an adjustable tension rod at the table center for providing a downward force on the table center, said base including a plurality of legs and a pair of generally circular positioning plates that lock the legs together approximately midway between the floor and the table bed.

7. A rotary table for a flat disc pool game, comprising: a base having a plurality of upwardly extending support legs, a substantially square table bed having a center and being supported substantially horizontally on the support legs, said bed having peripheral side rails mounted on the upper surface thereof with a plurality of pockets formed therein, a plurality of discs on the table bed adapted to be propelled into the pockets, said table bed pockets each including a removable tray one at each corner of the table bed, each of said trays having a vertical inner wall, said wall having a semicircular recess at an upper edge thereof, track means attached to said bed beneath each of said pockets and adapted to slidably receive a tray, said table being unobstructed under the trays so the trays may be removed for disc removal by grasping the bottom of the trays and pulling outwardly, and a plurality of spring clips fixed to the underside of the table bed and receivable on and engageable with said recess to both limit insertion of the trays into said track means and to non-positively lock the trays in position beneath said pockets.

* * * * *